US006266041B1

(12) United States Patent
Cairns et al.

(10) Patent No.: US 6,266,041 B1
(45) Date of Patent: Jul. 24, 2001

(54) ACTIVE MATRIX DRIVE CIRCUIT

(75) Inventors: Graham Andrew Cairns, Cutteslowe; Michael James Brownlow, Sandford on Thames, both of (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/054,675

(22) Filed: Apr. 3, 1998

(30) Foreign Application Priority Data

Apr. 4, 1997 (GB) ..... 9706941

(51) Int. Cl.[7] ..... G09G 3/36
(52) U.S. Cl. ..... 345/100; 345/98
(58) Field of Search ..... 345/98, 100, 197, 345/89, 147

(56) References Cited

U.S. PATENT DOCUMENTS

| | | | |
|---|---|---|---|
| 4,542,301 | 9/1985 | Narabu | 307/269 |
| 4,612,659 | 9/1986 | Starke | 377/72 |
| 4,746,915 | 5/1988 | Sekiya | 340/719 |
| 4,788,297 | 11/1988 | Sekiya | 340/802 |
| 5,252,957 | 10/1993 | Itakura | 345/98 |
| 5,384,496 | 1/1995 | Tanaka | 327/94 |
| 5,453,757 | 9/1995 | Data et al. | 345/89 |

FOREIGN PATENT DOCUMENTS

| | | |
|---|---|---|
| 0559321 | 9/1993 | (EP) . |
| 0678845 | 10/1995 | (EP) . |
| 0760508 | 3/1997 | (EP) . |

OTHER PUBLICATIONS

Search Report for Application No. GB 9706941.3; Dated Jun. 27, 1997.

European Search Report for Application No. 98302566.9–2205–; Dated Jun. 26, 1998.

T. Maekawa et al.; Journal of the Society for Information Display 1994; pp. 414–417; 1994; "A 1.35–in.–Diagonal Wide–Aspect–Ratio Poly–Si TFT LCD With 513k Pixels".

A. G. Lewis et al.; Journal of The Society for Information Display 1995; pp. 56–64, 1995; "Driver Circuits for AML-CDs".

Y. Matsueda et al.; SID Digest; pp. 21–24, 1996; "Low–Temperature Poly–Si TFT–LCD With Integrated 6–bit Digital Data Drivers".

S. N. Lee et al; 1990 IEEE International Solid–State Circuits Conference, pp. 220–221, 1990; "A 5x9 Inch Polysilicon Gray–Scale Color Head Down Display Chip".

*Primary Examiner*—Steven Saras
*Assistant Examiner*—Alecia Nelson
(74) *Attorney, Agent, or Firm*—Renner, Otto, Boisselle & Sklar

(57) ABSTRACT

An active matrix drive circuit includes a clock element arranged so as to generate a clock signal CK; a shift register including a chain of control shift elements having respective outputs; and a series of driver stages coupled to said outputs and controllable by control signals for sampling an input signal and for supplying the sampled signals to a corresponding series of lines. Each of the driver stages is associated with a respective one of the control shift elements and is locally controlled by a plurality of different control signals derived from signals generated by said one control shift element and/or at least one local control shift element in the vicinity of said one control shift element in the shift register in response to clocking of the shift register by the clock signal CK.

14 Claims, 11 Drawing Sheets

ACTIVE MATRIX DRIVE CIRCUIT

TECHNICAL FIELD OF THE INVENTION

This invention relates to drive circuits for active matrix devices and is concerned more particularly, but not exclusively, with drive circuits for active matrix liquid crystal displays (AMLCD's).

The drive circuits of the invention can be used to generate the control and data signals for thin-film display panels and two-dimensional imaging equipment, for example, and find particular application in computer graphics displays receiving digital RGB data. In such displays, digital data driver circuits are provided which may be implemented in separate large scale integration (LSI) driver chips mounted on the display panel, or which may alternatively be integrated on the display panel in the form of thin-film transistors (TFT) using silicon-on-insulator (SOI) technology, and preferably the emerging polysilicon technology. In either of these two alternative implementations, the digital data line driver circuits must be adapted to convert the data input in the form of parallel digital data into analogue voltages to be applied to the pixels of the display by means of digital-to-analogue (D/A) converters. Although the construction of the D/A converters used may vary, most D/A converters require more than one (pixel frequency) control signal for successful operation, and the driver circuits of the invention are particularly advantageous in such circumstances.

DESCRIPTION OF THE RELATED ART

FIG. 1*a* shows a typical AMLCD 1 composed of N rows and M columns of pixels addressable by scan lines 2 connected to a scan line driver circuit 3 and data lines 4 connected to a data line driver circuit 5. Data voltages are applied to the data lines 4 by the data line driver circuit 5 and scan voltages are applied to the scan lines 2 by the scan line driver circuit 3 so that such voltages in combination serve to apply analogue data voltages to the pixel electrodes 6 (as best seen in the enlarged detail of a part of the display shown in FIG. 1*b*) in order to control the optical transmission states of the pixels along each row as the rows are scanned in a cyclically repeating sequence. This is achieved as follows for a single row of pixels. The data line driver circuit 5 reads a line of data to be displayed by the row of pixels and applies corresponding data voltages to the data lines 4 so as to charge up each data line 4 to the required data voltage. The scan line 2 corresponding to the row of pixels to be controlled is activated by the application of the scan voltage by the scan line driver circuit 3 so that a TFT 7 associated with each pixel is switched on to transfer charge from the corresponding data line 4 to a pixel storage capacitance 8 (as shown in broken lines in the figure) associated with the pixel. When the scan voltage is removed the TFT 7 isolates the pixel storage capacitance 8 from the data line 4 so that the optical transmission state of the pixel corresponds to the voltage across the pixel storage capacitance 8 until the pixel is refreshed during the next scanning frame. The rows of pixels are refreshed one at a time until all the rows have been refreshed to complete refreshing of a frame of display data. The process is then repeated for the next frame of data.

It is known, for example from European Published Patent Application No. 0678845, to form the data line driver circuit 5 from a shift register 9 and a bank 10 of data line drivers (one driver per column of pixels). Furthermore the scan line driver circuit 3 typically consists of a shift register 14 and a bank 15 of scan line buffers (one buffer per row of pixels). Furthermore it is known, for example from U.S. Pat. No. 4,612,659, to form the data line driver circuit 5 from a shift register 9 composed of a cascaded chain of D-type flip-flops (DFF's) and a bank 10 of data line drivers in the form of TFT's 12 for sampling an analogue video (AVIDEO) signal and charging the corresponding data lines 4 having associated parasitic capacitances 13 as shown in broken lines in the small figure. In operation the shift register 9 is initialised by a horizontal synchronisation signal HSYNC such that the outputs of all but one of the DFF's 11 are set at a low logic level '0' and the output of the remaining DFF 11 is set at a high logic level '1'. The shift register 9 is then clocked by a clock signal CK at the pixel data rate frequency which is equal to small f×N×M Hz, where f is the frame rate of the display. This causes the DFF 11 having its output at level '1' and the following DFF 11 having its output at level '0' to change state, so that the level '1' effectively circulates within the shift register 9 at the clocking frequency, and as a result sequential pulses are generated for application to the data lines 4. Such a point-at-a-time driving scheme is widely used for analogue displays of small size or low pixel resolution.

Several improvements to such a driving scheme have been proposed. U.S. Pat. No. 4,785,297 discloses a data line driver circuit having a shift register consisting of a chain of master-slave flip-flops with both the master output and the slave output of each flip-flop being used to control the data line drivers, thus enabling the clocking rate of the shift register to be reduced. It is now common practice for the shift register of such a data line driver circuit to be composed of a chain of latches. Also, in order to minimise both the capacitative loading of the clock line or lines and the power consumption of the circuit, it is known to apply state-controlled clocking schemes to the shift register. For example U.S. Pat. No. 4,746,915 discloses a data line driver circuit comprising a first shift register which is split into smaller banks of DFF's or latches and a further shift register, operating at a lower frequency than the first shift register, which is used to selectively apply a clock signal to each bank of DFF's or latches. However, in all these circuit arrangements, it is only the flip-flop having its output at the '1' level and the flip-flop having a '1' at its input which require clocking in response to each clock pulse. FIG. 3 shows a data line driver circuit 20 in which the input and output of each DFF 21 is coupled to a respective input of an associated OR gate 22 which controls a pass gate 23 so as to ensure that only the required DFF's 21 are clocked by each clock pulse, as disclosed by T. Maekawa, Y. Nakayama, Y. Nakajima, M. Ino, H. Kaneko, M. Satoh and M. Kobayashi, 'A 1.35-in.-diagonal wide-aspect-ratio poly-Si TFT LCD with 513 k pixels', Journal, Pages 414–417, 1994.

The complexity of the data line drivers of such data line driver circuits is dependent on the size and resolution of the display and whether the display interface is analogue or digital. As already mentioned, the very simple data line drivers of the point-at-a-time driving scheme of FIG. 2 are adequate for analogue displays of small size or low pixel resolution. However, for a line-at-a-time driving scheme, such as that of A. Lewis and W. Turner, 'Driver circuits for AMLCD's', Journal of the Society for Information Display, Pages 56–64, 1995, more complex data line drivers are required, and this necessitates an increased number of control signals for controlling the operation of the circuit. For a typical analogue line-at-a-time data line driver circuit, each data line driver comprises two capacitative memory elements for storing sample signals and two data line buffers for applying the stored sample signals to the data lines, and, in addition to the pixel data rate sampling pulse, control signals are needed to select which of the two capacitative memory elements is used and which of the two data line buffers is enabled. These control signals generally operate at the line frequency of the display.

FIG. 4 shows the general architecture of a digital line-at-a-time data line driver circuit 30 which comprises an input register 31 to which digital video data is supplied in 6 or 8 bit RGB format, a storage register 32 in the form of digital latches, and digital-to-analogue converters 33 connected to the outputs of the storage register 32 and supplied with reference voltages for applying data to the data lines by way of output buffers 34. As the digital data bits are supplied to the input register 31, they are stored in the register 32 and, when a whole line of data has been stored, the contents of the input register 31 is transferred to the storage register 32 in order to control the D/A converters 33. In the case of small screen displays, the D/A converters may be connected directly to the data lines so as to charge the data lines by simple charge sharing, although output buffers are required for higher performance displays. Control logic 35 is provided for controlling the input register 31, the storage register 32, the D/A converters 33 and the buffers 34 on receipt of appropriate control signals.

The D/A converters may be parallel converters, such as converters based on binary weighted capacitances as disclosed by Y. Matsueda, S. Inoue, S. Takenaka, T. Ozawa, S. Fujikawa, T. Nakazawa, and H. Oshima, 'Low-temperature poly-Si TFT-LCD with integrated 6-bit digital data drivers', Society for Information Display 96 Digest, Pages 21–24, or converters based on voltages as disclosed in U.S. Pat. No. 5,453,757. Alternatively the D/A converters may be serial converters, such as the ramp and counter converters as disclosed by A. Lewis and W. Turner, 'Driver circuits for AMLCD's' referred to above, or converters based on a switched capacitor algorithm as disclosed by P. Allen and D. Holberg, 'CMOS Analog Circuit Design', Harcourt Brace Jovanovich College Publishers, 1987. Each type of converter has unique benefits depending on the display performance required and on the process technology used. The circuit of the present invention is particularly advantageous when used in a digital data line driver circuit employing a serial algorithmic switched capacitor D/A converter because of the requirement for a number of control signals which operate at the pixel data rate frequency.

The control logic 35 of FIG. 4 receives external control signals, such as the frame synchronisation signal VSYNC and the line synchronisation signal HSYNC, and generates global control signals for the input register 31, the storage register 32, the D/A converters 33 and the buffers 34. FIGS. 5*a* and 5*b* show possible arrangements for generating such global control signals, such as are disclosed, for example, by F. Hill and G. Peterson, 'Digital Logic and Microprocessors', John Wiley and Sons, 1984. In the arrangement of FIG. 5*a,* which is typically used when many different control signals are required, a counter 36 is driven by a clock signal so as to provide different output signals B0 . . . BN, and combinational logic 37 combines the counter output signals in such a way as to produce the desired global control signals G1,.G2 . . . In the state-machine arrangement of FIG. 5*b,* the clock signal is supplied to N J/K flip-flops 38 of a shift register having outputs connected to inputs of combinational logic 39 as shown so as to generate N global control signals with a total of $2^N$ states. However such known arrangements for producing global control signals suffer from a number of disadvantages, particularly when used in a circuit in which many different control signals are required at different locations within the circuit. Such disadvantages include the fact that the operating frequency may be limited by the capacitative loading per signal, and in addition the necessary circuit complexity introduced by such arrangements increases both the implementation area and the cost of the circuit, as well as tending to increase power consumption.

SUMMARY OF THE INVENTION

It is an object of the invention to provide a novel active matrix drive circuit which provides a number of advantages in use, particularly when used for monolithic drive circuits of TFT LCD's, such as polysilicon AMLCD'S.

According to the present invention there is provided an active matrix drive circuit comprising clock means for generating a clock signal, a shift register comprising a chain of control shift elements having respective outputs, and a series of driver stages coupled to said outputs and controllable by control signals for sampling an input signal and for supplying the sampled signals to a corresponding series of lines, wherein each of the driver stages is associated with a respective one of the control shift elements and is locally controlled by a plurality of different control signals derived from signals generated by said one control shift element and/or at least one local control shift element in the vicinity of said one control shift element in the shift register in response to clocking of the shift register by the clock signal.

Such a circuit provides a number of significant advantages as compared with prior arrangements such as those described above with reference to FIGS. 5*a* and 5*b* in which global control signals are generated by a global counter and/or combinational logic. Since the circuit of the invention allows the control signals to be generated locally, a major advantage of the invention is the reduction in implementation area brought about by the minimisation of system complexity. As it is not necessary to use an extra counter and combinational logic, the display bevel width required to implement the drive circuit can be minimised. Furthermore, by reducing the use of global signals, it is possible for higher performance in terms of operating frequency to be achieved due to the capacitative loading per signal being lower and the signal rise and fall times being faster. Furthermore the average length of the signal lines can be reduced, thus eliminating signal time skew problems. These advantages are particularly significant in digital data line driver circuits which are integrated in thin-film displays, such as polysilicon-based AMLCD's.

Furthermore the circuit of the invention will tend to cause adjacent line drivers to commence their operative cycle at data rate clock intervals, and this will have the effect of smoothing the power dissipation of the circuit. This is in contrast to the way that the majority of conventional digital drive circuits operate where adjacent D/A converters are clocked simultaneously. As a result the circuit of the invention may bring about a reduction in the amount of voltage supply compensation and minimise switching interference on the data lines.

In one embodiment of the invent ion, each of the driver stages is locally controlled by at least one control signal generated by said one control shift element and at least one further control signal generated by at least one local control shift element immediately adjacent to said one control shift element in the shift register. For example, each of the driver stages may be locally controlled by at least one control signal generated by said one control shift element, at least one further control signal generated by at least one local control shift element immediately preceding said one local control shift element in the shift register, and at least one further control signal generated by at least one control shift element immediately following said one control shift element in the shift register.

In another embodiment of the invention, the shift register includes a chain of programmed shift elements having outputs which are set to define a control signal pattern on receipt of a reset signal, and each of the driver stages is locally controlled by at least one control signal generated by said one control shift element as a result of the control signal pattern appearing at the output of said one control shift element on clocking of the shift register by the clock signal. Preferably the programmed shift elements comprise a number of control shift elements located in an end portion of the shift register, and the output of the last control shift element is connected to the input of the first control shift element of the shift register. Alternatively the programmed shift elements are additional to the control shift elements and are located in a portion of the shift register preceding the control shift elements so that the output of the last programmed shift element is connected to the input of the first control shift element.

By specifying the control signal pattern defined by the programmed shift elements, the timing of clocking signals can be arbitrarily chosen and this allows for optimum D/A performance in a digital data line driver circuit, for example by allowing longer intervals for conversion of the most significant bits.

In a further embodiment of the invention, each of the driver stages is locally controlled by at least one control signal generated by combinational or sequential local logic means associated with said one control shift element in response to input signals from said one control shift element and/or at least one local control shift element in the vicinity of said one control shift element in the shift register. Preferably the outputs of said one control shift element and at least one local control shift element in the vicinity of said one control shift element are coupled to inputs of said local logic means associated with said one control shift element.

In a still further embodiment of the invention, the shift register includes a chain of programmed shift elements having outputs which are set to define a control signal pattern on receipt of a reset signal, and local pattern detection means connected to the output of at least one control shift element is adapted to generate a control signal in response to detection of the control signal pattern when the control signal pattern appears at the output of said one control shift element as a result of clocking of the shift register by the clock signal.

Where the drive circuit is used in an active matrix device comprising an active matrix of control elements disposed at intersections of data lines and scan lines, each of the driver stages is arranged to supply a data signal to a respective one of the data lines in a line period determined by a scan line driver.

In a preferred application to a digital active matrix device, each of the driver stages is arranged to sample a digital input signal and to store the sampled signal in a storage element, and digital-to-analogue conversion means is provided for converting the sampled signal to analogue format prior to supplying the signal to the corresponding data line in response to a control signal supplied by sample/shift means.

Furthermore, in use of the drive circuit for sequentially addressing rows of control elements in successive line periods, it is preferred that each of the driver stages comprises first actuating means for sampling and storing the input signal to produce data signals for a first group of control elements along a row in a first subperiod of a corresponding line period and for supplying said data signals to the first group of control elements in a second subperiod of said line period, and second actuating means for sampling and storing the input signal to produce data signals for a second group of control elements along said row in a second subperiod and for supplying said data signals to the second group of control elements in a subsequent subperiod.

Such a drive circuit is particularly advantageous when used in a half-line-at-a-time driving scheme as described in British Patent No. (96056 SLE) since control signals can conveniently be produced to effect the time sequential operation of the data line drivers, and to clock the scan line drivers where a split scan line driving scheme is used. Very low power operation can also be achieved by incorporating appropriate state-controlled clocking so that only shift elements having a logic level "1" at their input or output needed to be clocked.

BRIEF DESCRIPTION OF THE DRAWINGS

In order that the invention may be more fully understood, reference will now be made, by way of example, to the accompanying drawings, in which.

DETAILED DESCRIPTION OF THE INVENTION

Figure 2:
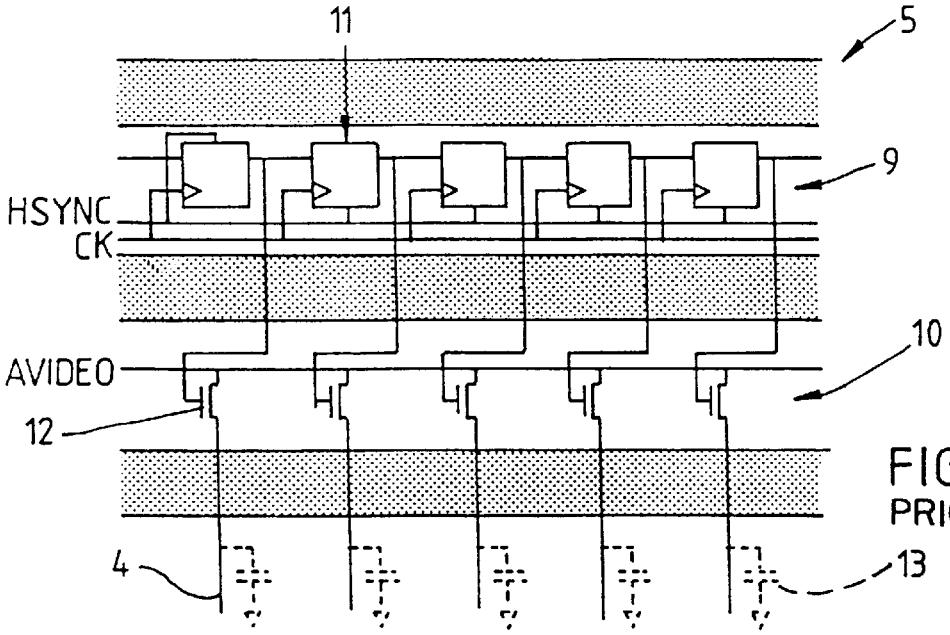
FIG. 2 PRIOR ART
FIGS. 2 and 3 show prior art point-at-a-time data line driver circuits.
Figure 3:
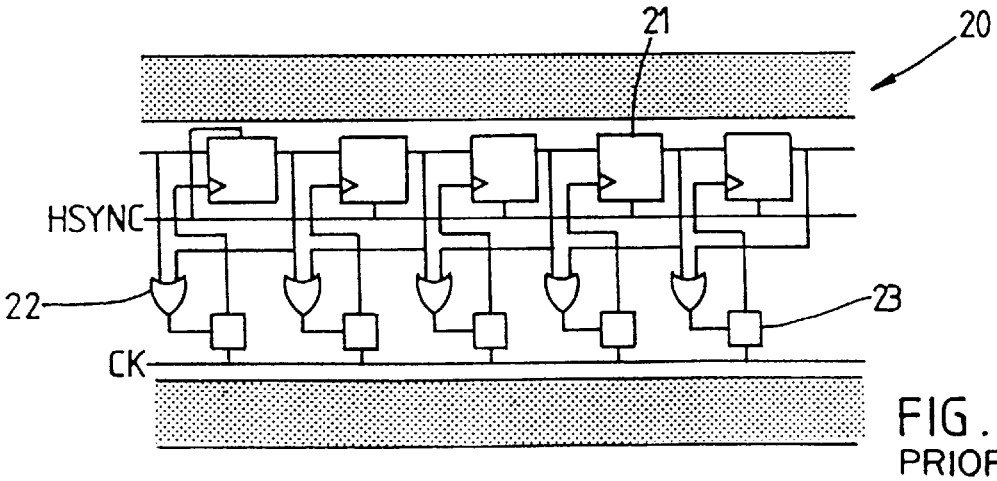
FIG. 3 PRIOR ART
Figure 4:
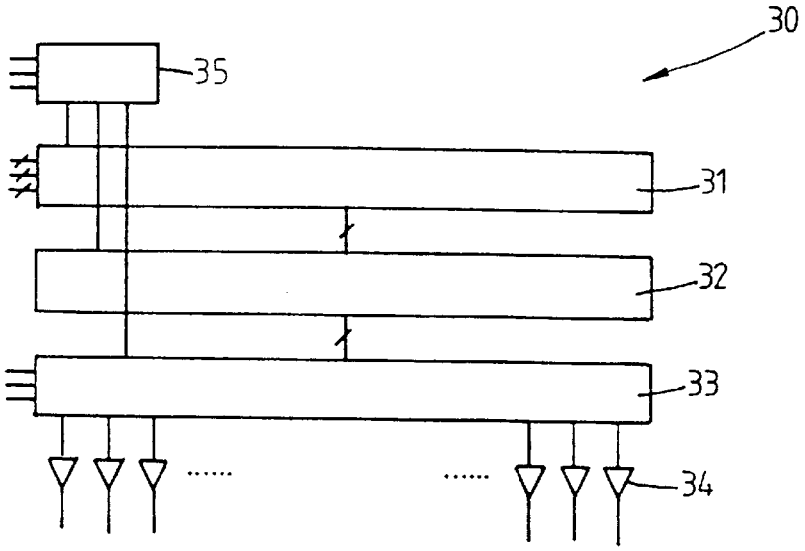
FIG. 4 PRIOR ART
FIG. 4 shows a prior art line-at-a-time data line driver circuit.
Figure 6:
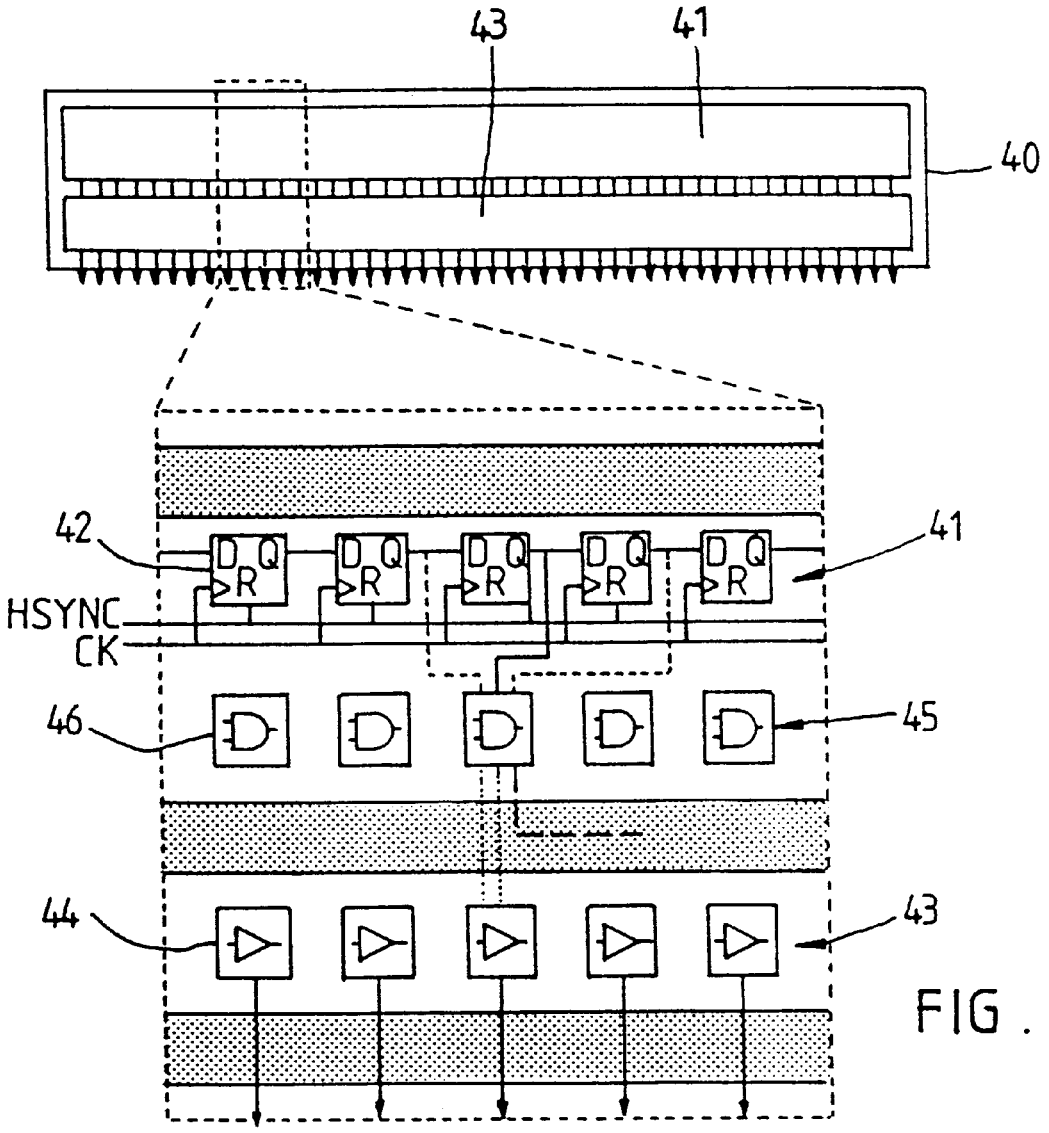
FIG. 6 diagrammatically shows a data line driver circuit in accordance with the invention.

Before describing specific embodiments of drive circuit in accordance with the invention, reference will first be made to the generalised diagram of FIG. 6 showing, in the lower half of the figure, a detail of a data line driver circuit 40 consisting of a shift register 41 composed of a chain of DFF's 42, and a bank 43 of data line drivers 44. By contrast with the circuit of FIG. 2, such a circuit 40 incorporates a bank 45 of combinational or sequential logic blocks 46 each of which is locally associated with a respective one of the DFF's 42 and may contain pattern detection logic. Each local logic block 46 receives signals from the outputs of one or more of the local DFF's 42 and generates one or more local control signals for the associated data line driver 44, and the pattern detection logic may also generate one or more global control signals. The circuit 40 therefore operates as a distributed controller which generates control signals locally, rather than such signals being generated by a global counter and/or combinational logic circuits as in the prior art circuit arrangements described above. As mentioned above, by allowing for the control signals to be generated locally, the circuit complexity can be minimised and as a result the implementation area of the circuit is reduced. Furthermore, by reducing the use of global signals, the invention affords higher performance in terms of operating frequency to be achieved due to the capacitative loading per signal being lower and the signal rise and fall times being faster. Also signal time skew problems can be eliminated because the average length of the signal lines is reduced. The control signals for each data line are generated by one of four possible circuit arrangements as will be described below with reference to FIGS. 7*a,* 7*b,* 8*a,* 8*b,* 10, 13*a* and 13*b.*

Figure 7A:
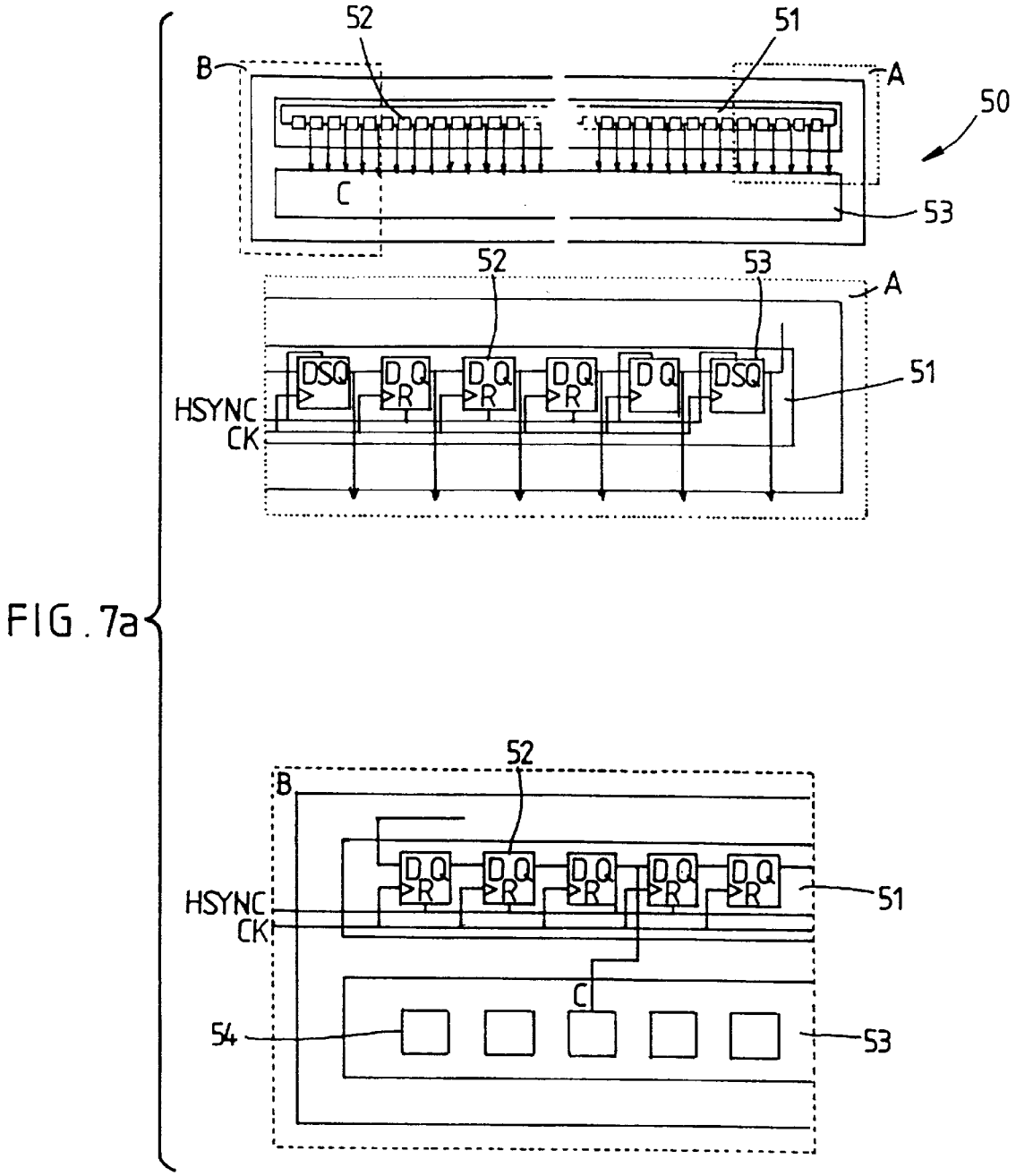
FIGS. 7*a* and 7*b* show a first embodiment of the invention and corresponding timing diagram.

FIG. 7*a* shows the fundamental construction of a distributed controller 50 in accordance with a first embodiment of the invention incorporating a shift register 51 composed of M cascaded DFF's or latches 52, the output of the last DFF or latch being connected to the input of the first DFF or latch, and the outputs of the DFF's or latches 52 being connected to a bank 53 of line drivers 54. FIG. 7*a* also shows enlarged details A and B of the left hand end of the controller 50 and the right hand end of the shift register 51 respectively.

Figure 7B:
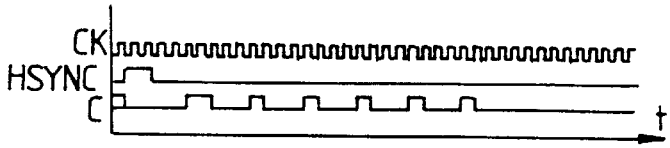

In operation the shift register 51 is initialised by the horizontal synchronisation signal HSYNC such that the outputs of all of the DFF's 52 are set to a '0' level with the exception of particular DFF's 53, such as the two end DFF's in the detail A for example, which are set to a '1' level. It will be appreciated from detail A that these DFF's 53 are hard-wired so that their set inputs S are connected to the HSYNC line, as opposed to the other DFF's 52 which have their reset inputs connected to the HSYNC line. In the particular example given the DFF's 53 are positioned such that the initial state of the shift register 51 is 000 . . . 000100010001000100010001000100011. Furthermore, as the shift register 51 is clocked by the clock signal CK, the state of each DFF 52 is passed to the next DFF along the register 51, and the effect of such clocking on the output C of the third DFF 52 from the left in the detail B is shown in the timing diagram of FIG. 7*b,* together with the clock signal CK and the horizontal synchronisation signal HSYNC. It will be appreciated that the output C incorporates a series of pulses of the duration of one period of the clock signal CK corresponding to each '1' level separated by gaps of three clock periods corresponding to the three consecutive '0' levels, as well as a pulse of two clock periods corresponding to the two consecutive '1' levels. The form of such an output C is particularly useful for controlling each line driver 54 as will be described in more detail below. Since such a circuit will tend to cause adjacent line drivers 54 to commence their operative cycle at data rate clock intervals, this will have the effect of smoothing the power dissipation of the circuit. As a result the circuit may bring about a reduction in the amount of voltage supply compensation and minimise switching interference on the data lines.

A key feature of such a controller 50 is that an arbitrary sequence of '1' levels can be pre-programmed into the shift register 51 with a view to producing a control signal pattern for generating any required combination of multiple pulse control signals. Thus the shift register 51 effectively operates as a one-bit programme sequencer with the output of each element of the sequencer being used simultaneously to drive circuits at intervals separated by a single clock period (or by half a clock period if latches are used in place of flip-flops).

Figure 8A:
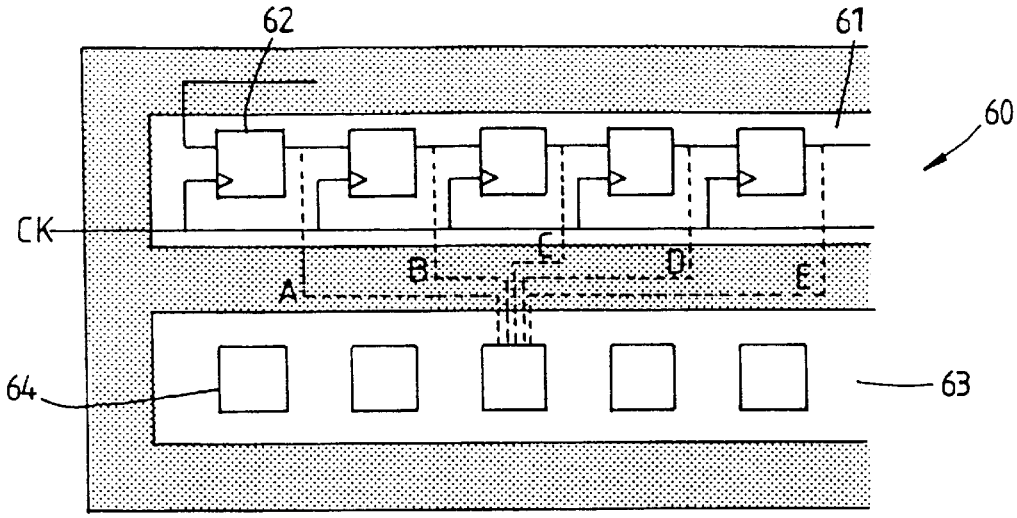
FIGS. 8*a* and 8*b* show a second embodiment of the invention and corresponding time diagram.
Figure 8B:
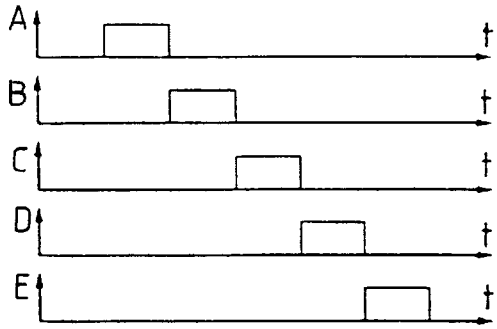

The above-described embodiment is useful for generating multiple pulses on the same signal line. However control of complex line drivers usually involves the use of more signal lines. FIG. 8*a* shows the fundamental construction of a distributed controller 60 in accordance with a second embodiment of the invention comprising a shift register 61 composed of M DFF's or latches 62, and a bank 63 of line drivers 64. In this embodiment the outputs A, B, C, D and E of a number of local DFF's 62 are supplied as control signals to each line driver 64, as shown in broken lines in FIG. 8*a* for one of the line drivers 64. Such an arrangement ensures the supply of multiple control signals, as shown in the timing diagram of FIG. 8*b,* to each of the line drivers 64. In the particular example given the output of the last DFF (not shown) is connected to the input of the first DFF and the last DFF only is wired so that the initial state of the shift register is 000 . . . 000001. One drawback of such a scheme is that the different signals are not independent. In fact they are the same except that they are shifted in time relative to one another. Nevertheless such a scheme is adequate for most line drivers, as will be discussed in more detail below.

Figure 9A:
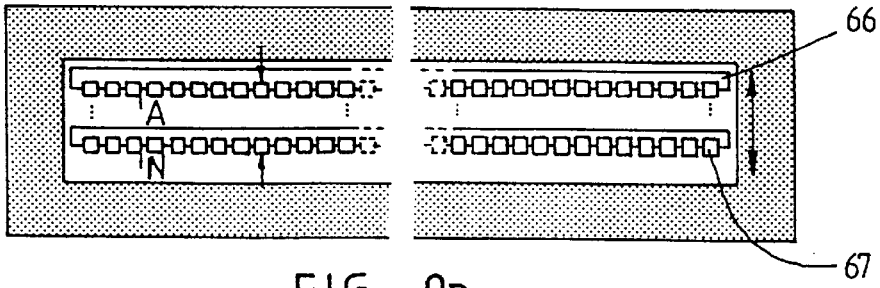
FIGS. 9*a* and 9*b* show a development of the second embodiment for generating multiple independent control signals and corresponding timing diagram.
Figure 9B:
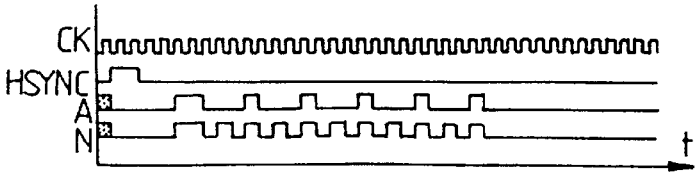

An alternative scheme for generating multiple independent control signals is shown in FIG. 9*a* in which N shift registers 66 are connected in parallel, each shift register 66 consisting of M DFF's 67. Each shift register 66 is constructed so as to be set to an initial state corresponding to a particular sequence of levels. For example, the first shift register may have an initial state 000 . . . 001000100010001000100011 and the last shift register 66 may have an initial state 000 . . . 001010101010101010101011. Considering the third line driver from the left, for example, the line driver will receive output signals A . . . N from the corresponding DFF's 67 of the N shift registers 66, and the timing diagram FIG. 9*b* shows the form of the signals A and N in this example. In this case multiple control signals are supplied to each line driver which can be programmed to be independent of one another, the bit widths of the stored programme being N.

Figure 10:
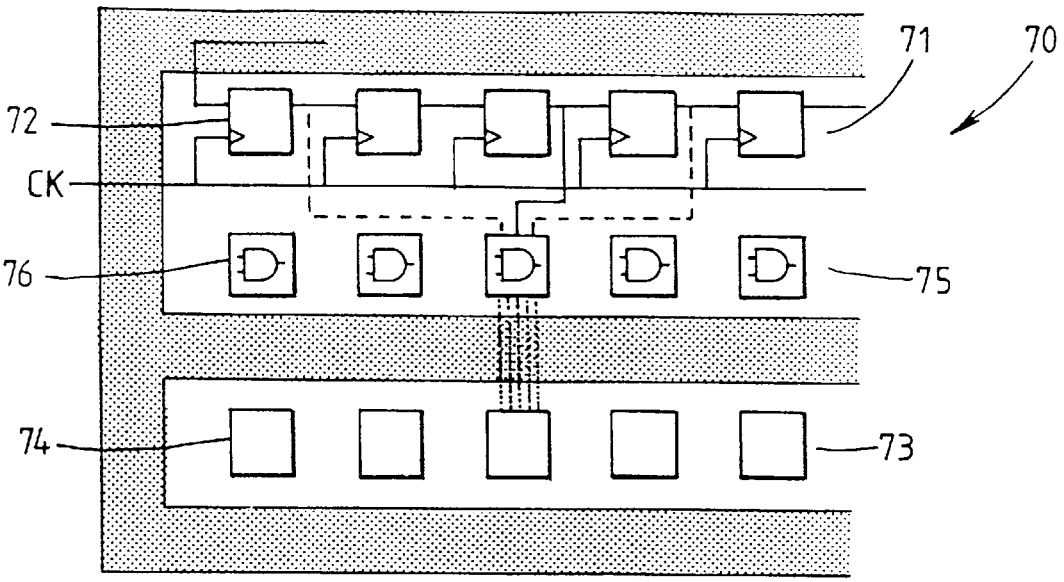
FIG. 10 shows a third embodiment of the invention.

FIG. 10 shows the fundamental construction of a distributed controller 70 in accordance with a third embodiment of the invention which uses local combinational or sequential logic. In this case the controller 70 comprises a shift register 71 consisting of M DFF's 72, a bank 73 of line drivers 74, and a bank 75 of local logic blocks 76. The outputs from a number of local DFF's 72 are supplied to each of the local logic blocks 76, and in each case the local logic block 76 performs a logical operation so as to locally generate multiple control signals from the appropriate output signals for supplying to the associated line driver 74.

Figure 11A:
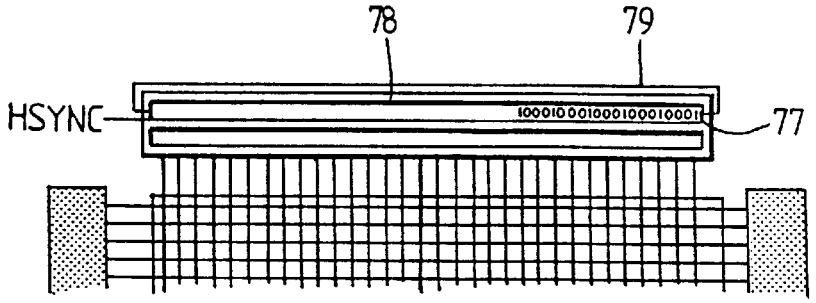
FIGS. 11*a* and 11*b* are explanatory diagrams showing possible locations of programmed flip-flops in the circuit of the invention.
Figure 11B:
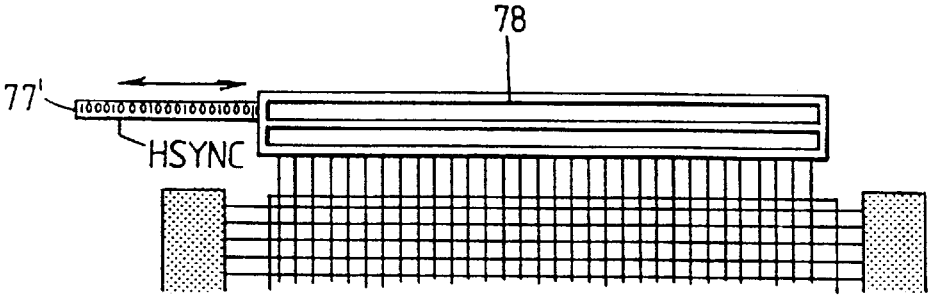

In each of the above-described embodiments the DFF's or latches which are programmed so that some of the DFF's or latches are set to a '1' level upon initialisation of the controller (whilst other DFF's or latches are set to an '0' level) can be positioned in one of two locations as shown in FIGS. 11*a* and 11*b*. In the example of FIG. 11*a*, the programmed DFF's or latches are located towards the end 77 of the shift register 78, and a connection 79 is made from the output of the last DFF to the input of the first DFF of the shift register 78, thus increasing the routing overhead. This is probably the best location when the number of programmed DFF's or latches is large. However, if the number of programmed DFF's or latches is small, the alternative arrangement of FIG. 11*b* may be used in which additional DFF's or latches 77' are provided at the beginning of the shift register 78, thus avoiding the need for a long feedback connection at the expense of requiring additional DFF's or latches.

Figure 1A:
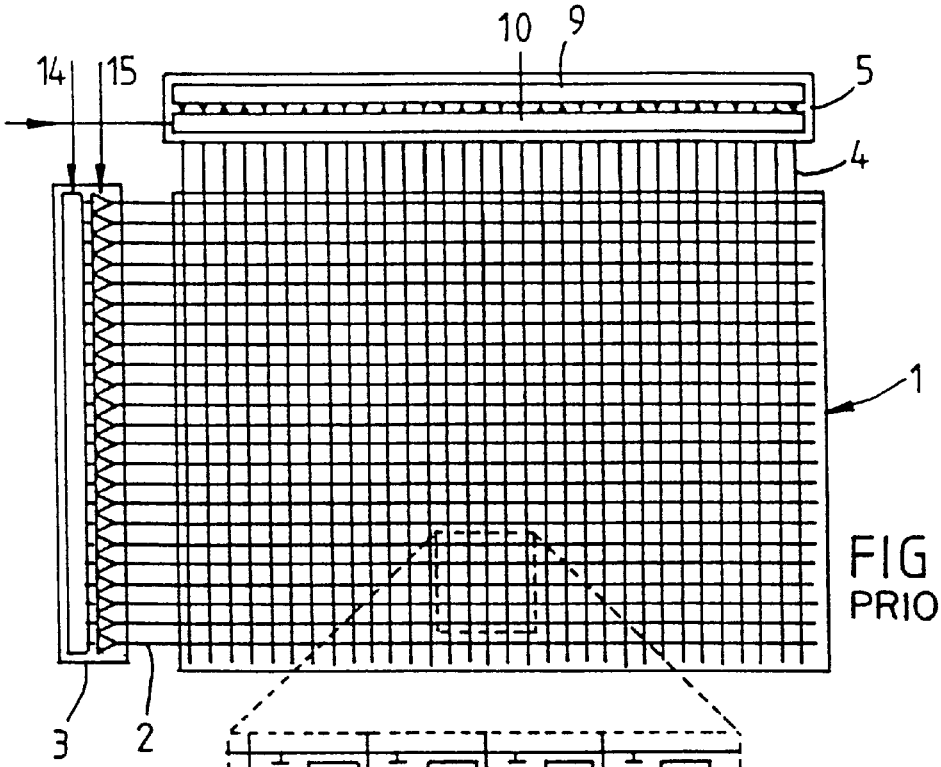
FIG. 1a PRIOR ART
FIGS. 1*a* and 1*b* diagrammatically shows a prior art AMLCD.
Figure 1B:
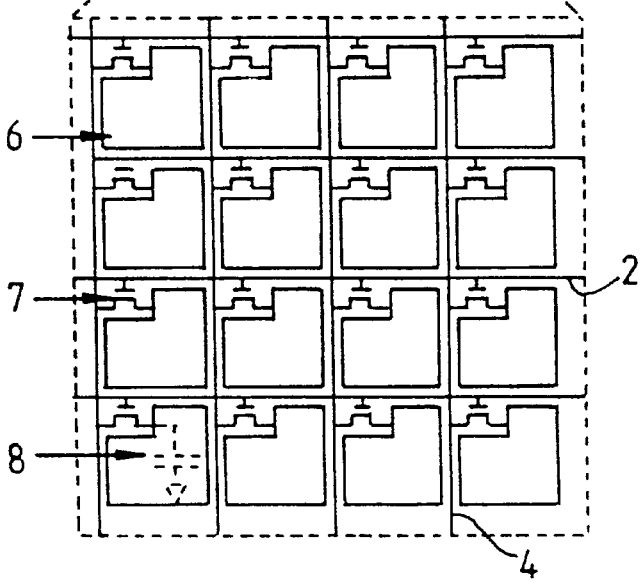
FIG. 1b PRIOR ART
Figure 12A:
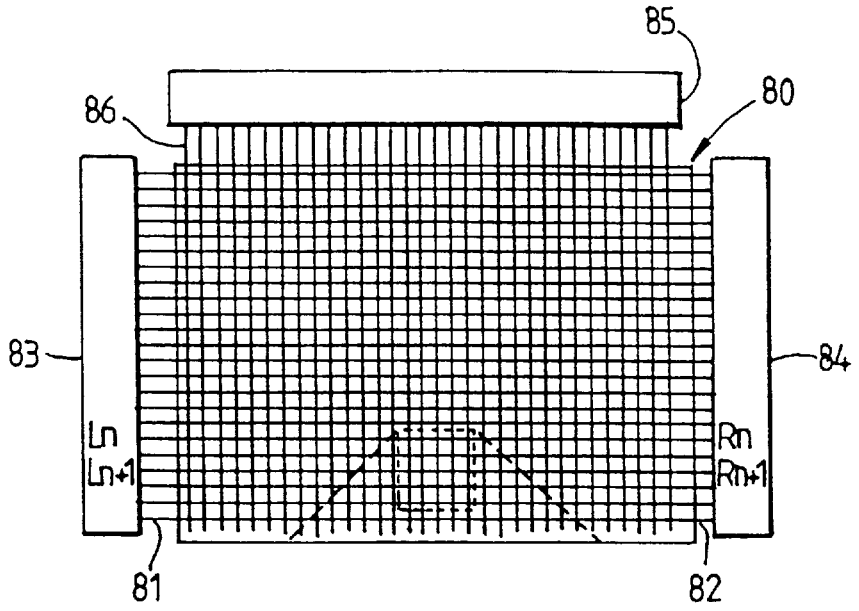
FIGS. 12*a* and 12*b* show an AMLCD utilising a half-line-at-a-time driving scheme in accordance with British Patent Application No. (SLE 96056) and corresponding timing diagram.
Figure 12B:
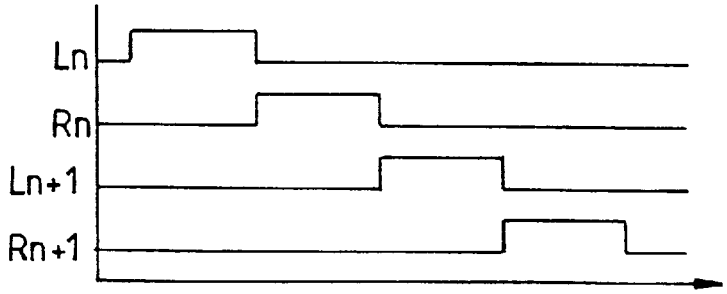

The above-described distributed controllers in accordance with the invention are particularly suitable for use with half-line-at-a-time driving schemes as described in British Patent Application No. (96056 SLE). FIG. 12*a* diagrammatically shows an AMLCD 80 of N rows and M columns utilising such a driving scheme based on split scan lines. In this case each row of pixels within the display has two scan lines 81 and 82, the scan line 81 connecting the gates of the TFT's of the left hand group of pixels to a left hand scan line driver circuit 83 and the scan line 82 connecting the gates of the TFT's of the right hand group of pixels to a right hand scan line driver circuit 84. Furthermore a data line drive circuit 85 is connected to the data lines 86 of the display. The structure of the display is as shown in FIG. 1*a*, for example. The two scan line driver circuits 53 and 84 generate signals out of phase with one another by half a line period, and the driving of such a display will be briefly described below with reference to the timing diagram of FIG. 12*b*.

Considering two adjacent rows n, n+1 within the display, the data for the left hand group of pixels of the row n is sampled in an initial sampling period, and the scan voltage Ln is then activated so that the left hand line drivers of the data line driver circuit 85 charge the left hand group of pixels of the row n, whilst at the same time the data for the right hand group of pixels of the row n is sampled. The scan voltage Ln is then deactivated and the scan voltage Rn is activated so that the right hand line drivers of the data line driver circuit 85 charge the right hand group of pixels of the row n, whilst at the same time the data for the left hand group of pixels of the next row n+1 is sampled. The scan voltage Rn is then deactivated and the scan voltage Ln+1 is applied to the left scan line 81 of the next row n+1 so that the left hand line drivers charge the left hand group of pixels of the row n+1, whilst at the same time the data is sampled for the right hand group of pixels of the row n+1. Such interleaved sampling/driving is then continued with the scan voltage Rn+1 being applied to the corresponding right scan line 82, and so on.

The reason for the suitability of the described distributed controllers to such a drive scheme is due to the time sequential operation of the data line driver circuit 85. During such operation each driver stage may be sampling input video data, performing digital-to-analogue conversion or holding a data line voltage. However, during one line period, there is not one instant when all the stages have stopped operating and all the line data voltages are readily available to be transferred to the pixels. For this reason a split scan line driving scheme is used as described above, or alternatively a switchable data line bank driving scheme is used as also described in the above-mentioned British patent application. A key condition for correct operation of a digital data line driver circuit for such a half-line-at-a-time driving scheme is that the D/A conversion and data line charging must be completed within half a line period. This also means that the number of combinations of control signals that can be pre-programmed into the distributed controller is $2^{M/2}$.

Figure 5A:
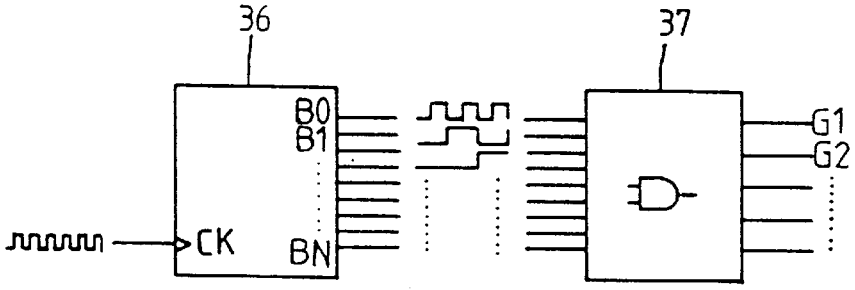
FIG. 5a PRIOR ART
FIGS. 5*a* and 5*b* show prior art control arrangements for such a circuit.
Figure 5B:
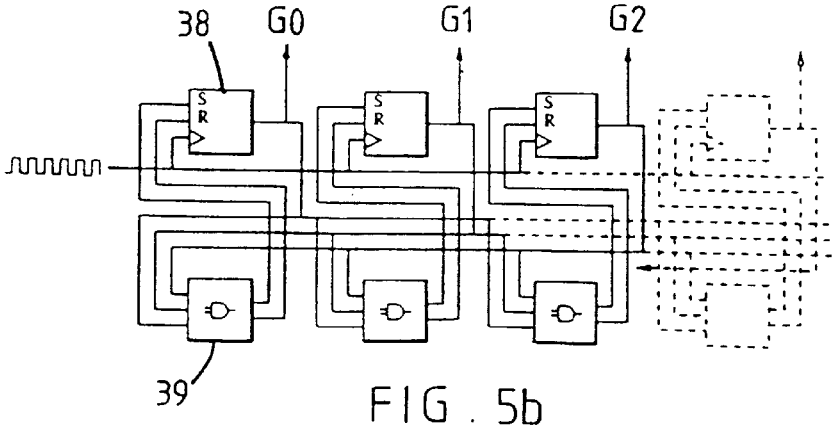
FIG. 5b PRIOR ART

When a distributed controller in accordance with the invention is to be used with such a half-line-at-a-time drive scheme, it is necessary to generate control signals of relatively low frequency with respect to the clock frequency. In the case of the split scan line driving scheme described above, for example, a control signal of double the line frequency is required to activate the left and right hand scan line drivers 83 and 84 within one line period. Such a control signal could be generated by conventional control techniques using a counter to divide the clock frequency and combinational logic as described with reference to FIG. 5*a* above. However a distributed controller 90 in accordance with a fourth embodiment of the invention, as shown in FIG. 13*a*, could alternatively be used.

Figure 13A:
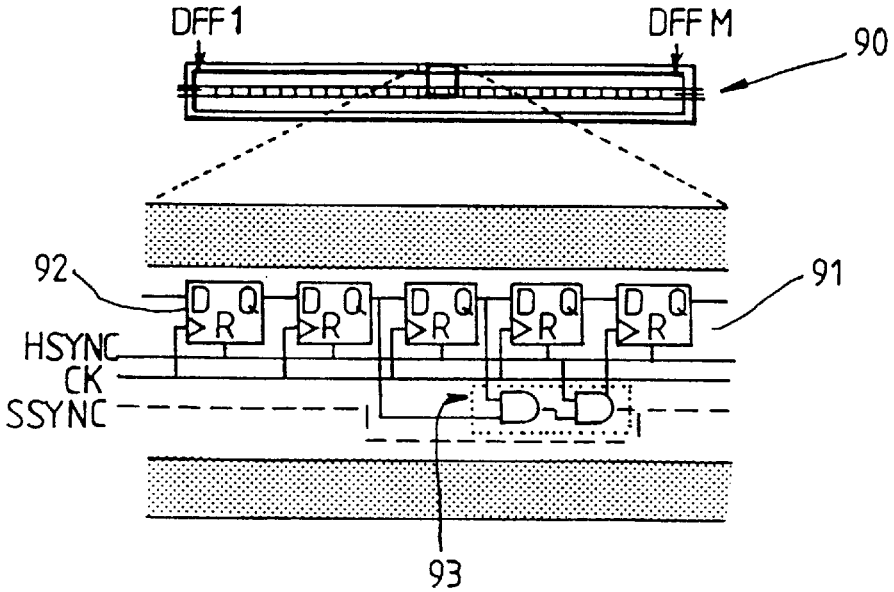
FIGS. 13*a* and 13*b* show a fourth embodiment of the invention and corresponding timing diagram.
Figure 13B:
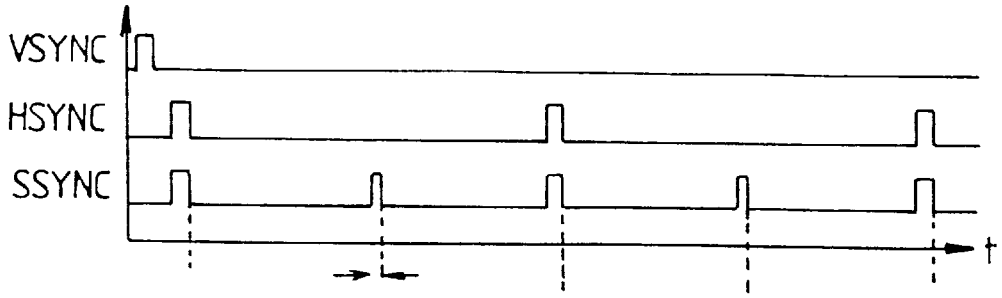

As shown in the enlarged detail of the controller 90 in the lower half of FIG. 13*a*, the controller 90 includes a shift register 91 composed of M DFF's 92, and associated pattern detection logic 93 which is used to detect when an identifiable signature programmed into the shift register 91 is present at a particular location within the shift register 91 in order to determine the instant at which the required control signal makes a transition. In a simple example, the identifiable signature is simply two '1' levels in succession which are preset in the shift register 91 in the manner described above. Furthermore the pattern detection logic 93 includes an AND gate connected to the outputs of successive DFF's at a location close to the middle of the shift register 91. At the expense of increased complexity of the pattern detection logic 93, the signature to be detected can be made identical to the signal control pattern within the shift register 91 so that no alteration to the internal pattern of the shift register 91 is in fact required. The timing diagram of FIG. 13*b* shows the SSYNC signal generated by the pattern detection logic 93 which, by virtue of the fact that the logic 93 includes a further AND gate having one input connected to the HSYNC line and the other input connected to the output of the first AND gate, includes pulses corresponding both to the pulses of the HSYNC signal and to detection of the signature by the first AND gate which provides an output which is high for a period equal to the pixel data rate (so that the pulse width of these pulses is equal to the width of the clock pulses).

Figure 14:
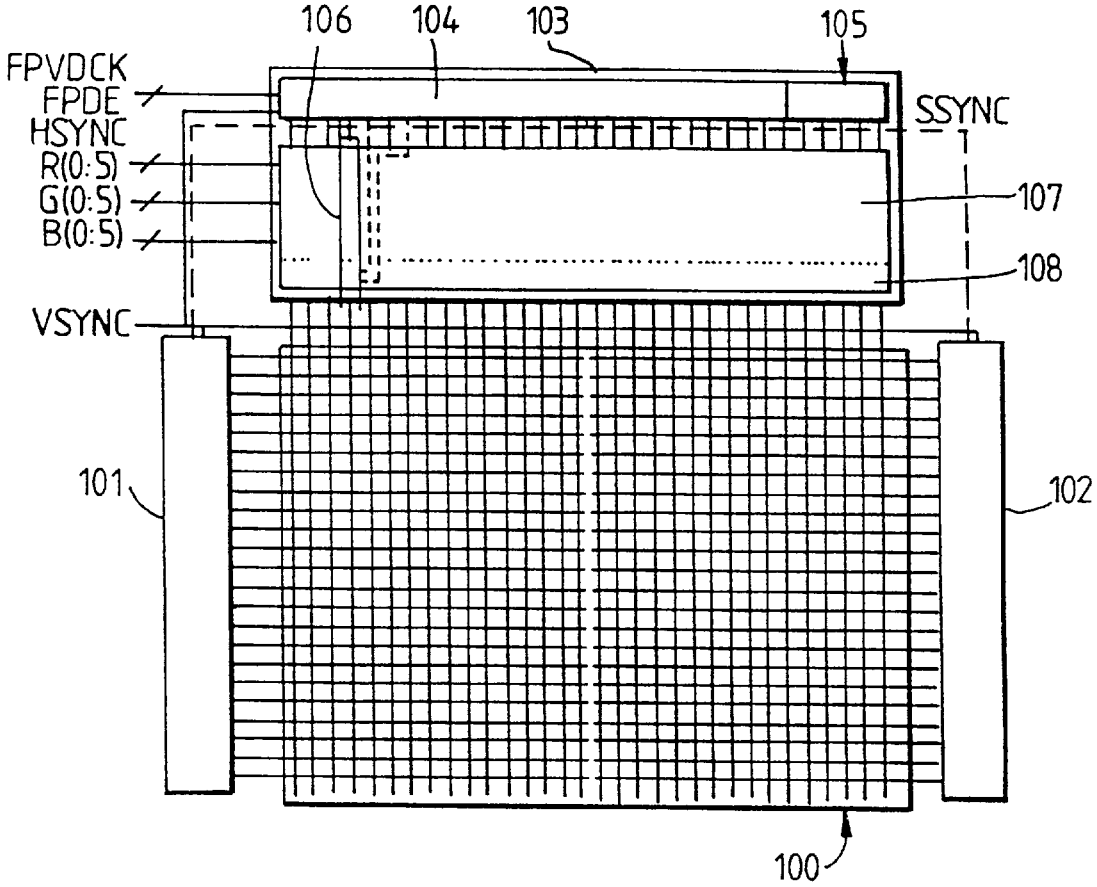
FIG. 14 diagrammatically shows an AMLCD utilising a half-line-at-a-time driving scheme and incorporating a drive circuit in accordance with the invention.

FIG. 14 shows an AMLCD 100 utilising a half-line-at-a-time driving scheme based on split scan lines generally as described above with reference to FIG. 12*a* and incorporating left and right hand scan line driver circuits 101 and 102 and a digital data line driver circuit 103 incorporating a distributed controller 104 in accordance with the invention as will be described in more detail below. The main signals which are received by the controller 104 are the horizontal line synchronisation signal HSYNC, the flat panel video clock signal FPVDCK (having a frequency equal to the pixel data rate) and the flat panel display enable signal FPDE. In the particular embodiment to be described with reference to FIG. 14, the controller 104 receives a further 19 digital signals, comprising the frame synchronisation signal VSYNC and the 3×6 RGB input data signals. The controller 104 generates control signals for the line drivers of each column using a combination of the techniques described with reference to FIGS. 7*a* and 7*b*, 8*a* and 8*b*, and 10, and is in the form of a shift register incorporating a signal control pattern 105 so as to generate control signals for the data driver stages 106 of the data line driver circuit 103 which also includes a digital data sample-and-shift array 107 (as described in British Patent Application No. (96055 SLE)) and serial D/A converters 108.

Figure 15:
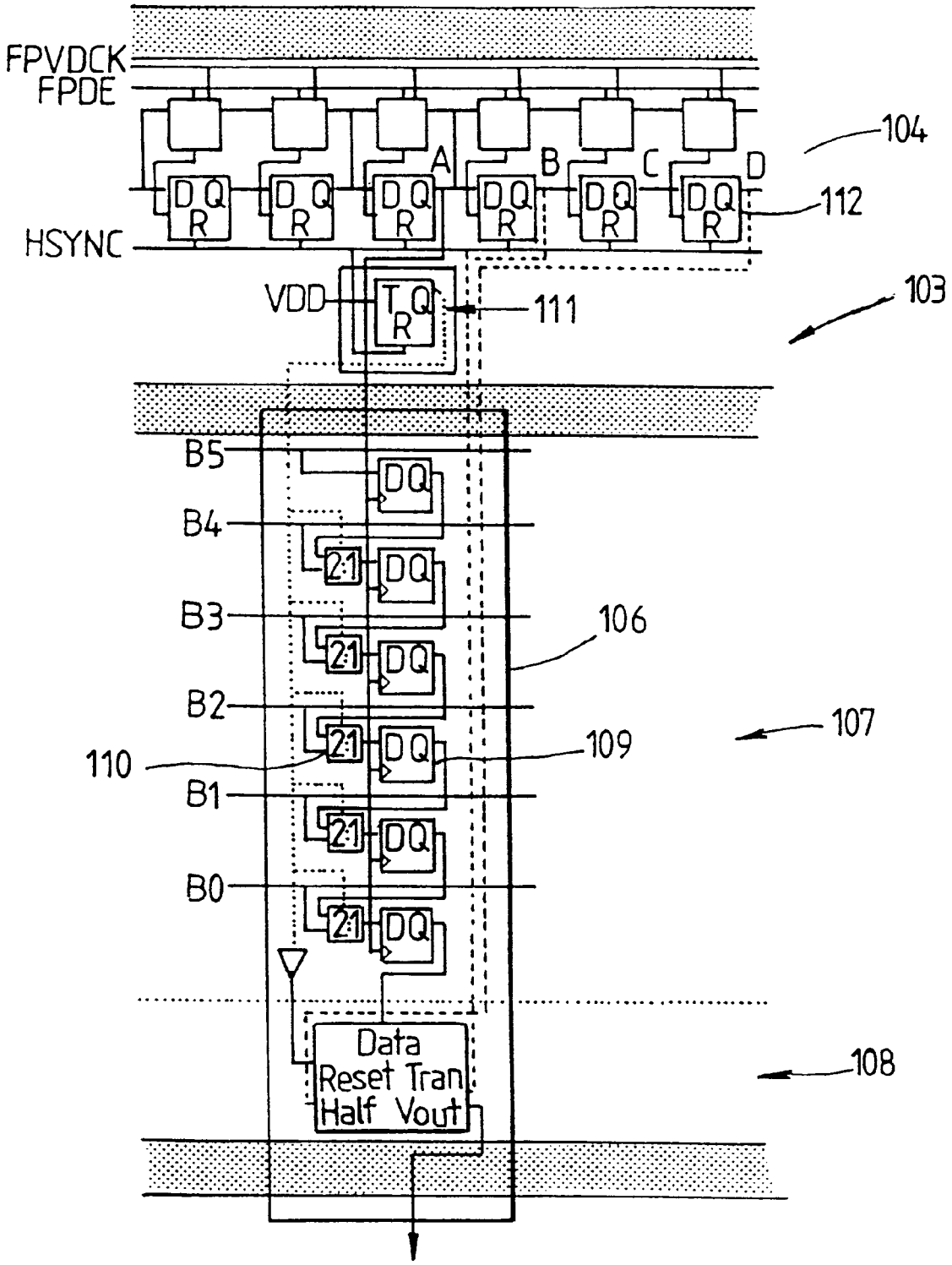
FIGS. 15 and 16 show a further embodiment of the invention and corresponding timing diagram.

The programmed DFF's defining the signal control pattern 105 of the controller 104 are located towards the end of the shift register and define an initial state 1100010001000100010001 (reading from right to left). Furthermore the output of the last DFF is connected to the input of the first DFF of the shift register. FIG. 15 shows a data driver stage 106 of the digital data line driver circuit 103 in more detail. The digital data driver stage 106 for each column comprises a digital data sample-and-shift array 107 and a serial D/A converter 108 comprising a series of DFF's 109 and associated 2:1 multiplexers 110 (switches) corresponding in number to the RGB data lines. The controller 104 also contains local sequential logic 111 in the form of a sample/toggle flip-flop for each data driver stage which is set to 0 by the HSYNC signal.

When set to 0 the logic 111 connects the DFF's 109 of the array 107 directly to the RGB data lines by means of the 2:1 multiplexers 110. During subsequent clocking of the controller 104, the programmed '1' levels within the shift register circulate and at some stage the first '1' in the signal control pattern 105 reaches the relevant data driver stage 106 and the output A of the relevant DFF 112 of the controller 104 goes high. This firstly causes the RGB input data to be sampled by the DFF's 109 of the array 107, and secondly causes the sample/shift latch to be toggled so that the 2:1 multiplexers 110 disconnect the DFF's 109 from the RGB data lines and instead connect the DFF's in a cascaded chain for shifting the stored data to the DIA converter 108. The generation of pulses at the output A in response to clocking by the FPVDCK signal results in shifting of the stored data, as shown in the timing diagram of FIG. 16, as required for conversion by the serial D/A converter 108.

Figure 16:
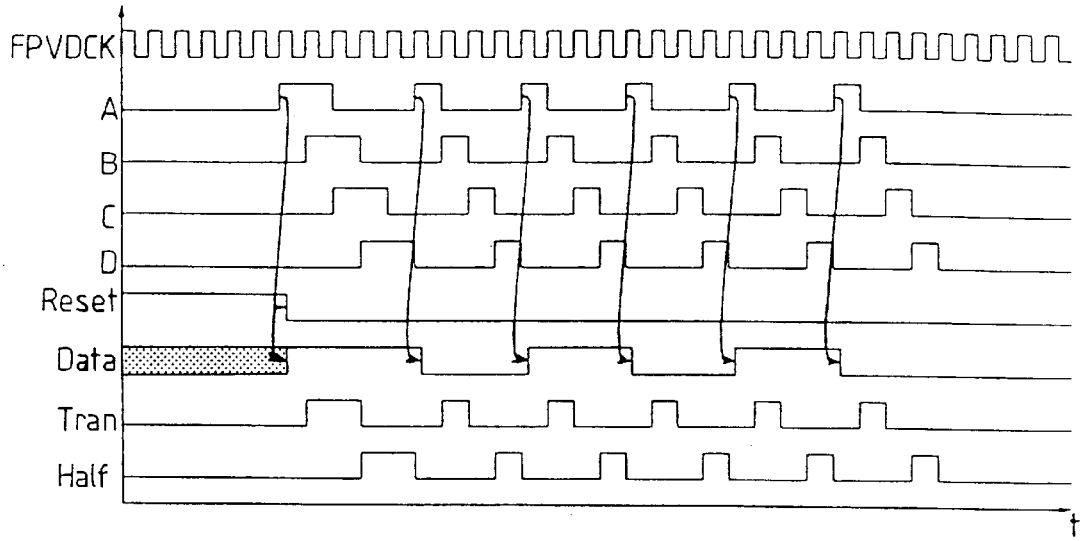
Figure 17:
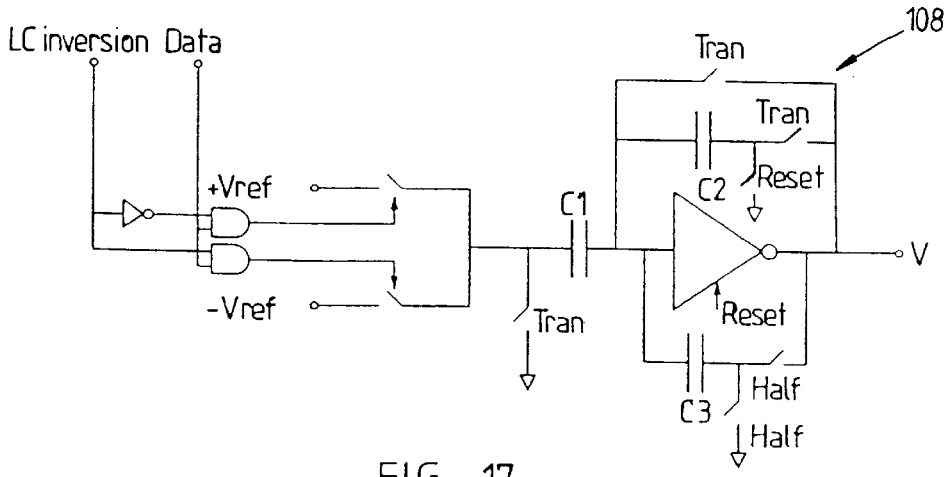
FIG. 17 shows a serial D/A converter for use in the further embodiment.

FIG. 17 shows an algorithmic switched capacitor D/A converter 108 usable in such a digital data line driver circuit 103. Since the operation of such a D/A converter 108 is known and is not relevant to an understanding of the operation of the distributed controller 104 in accordance with the invention, the operation of the D/A converter 108 will not be described in detail. All that is necessary is to describe the control signals reset by the Reset line going momentarily high. Then for each digital bit of the conversion three separate control signals are required successively, namely a Data bit signal, a Tran signal and a Half signal. The Tran signal and the half signal are control pulses, which must not overlap, and which correspond to the output signal of B and D of other DFF's 112 within the controller 104 which are routed back to the data driver stage 106 as shown by the broken lines in FIG. 15. The required timing signals for the converter 108 are shown in FIG. 16.

What is claimed is:

1. An active matrix drive circuit comprising:

a clock element arranged so as to generate a clock signal CK;

a shift register including a chain of control shift elements having respective outputs; and a series of driver stages coupled to said outputs and controllable by control signals for sampling an input signal and for supplying the sampled signals to a corresponding series of lines, wherein each of the driver stages is associated with a respective one of the control shift elements and is locally controlled by a plurality of different control signals derived from signals generated by said one control shift element and/or a least one local control shift element in the vicinity of said one control shift element in the shift register in response to clocking of the shift register by the clock signal CK, and the shift register includes a chain of programmed shift elements having outputs which are set to define a control signal pattern containing more than one occurrence of each logic state, and each of the driver stages is locally controlled by at least one control signal generated as a result of the control signal pattern appearing at the output of said one control shift element on clocking of the shift register by the clock signal.

2. An active matrix drive circuit according to claim 1, wherein each of the driver stages is locally controlled by at least one control signal generated by said one control shift element and at least one further control signal generated by at least one control shift element immediately adjacent to said one control shift element in the shift register.

3. An active matrix drive circuit according to claim 2, wherein each of the driver stages is locally controlled by at least one control signal generated by said one control shift element, at least one further control signal generated by at least one local control shift element immediately preceding said one local control shift element in the shift register, and at least one further control signal generated by at least one control shift element immediately following said one control shift element in the shift register.

4. An active matrix drive circuit comprising:

a clock element arranged so as to generate a clock signal CK;

a shift register including a chain of control shift elements having respective outputs; and a series of driver stages coupled to said outputs and controllable by control signals for sampling an input signal and for supplying the sampled signals to a corresponding series of lines, wherein each of the driver stages is associated with a respective one of the control shift elements and is locally controlled by a plurality of different control signals derived from signals generated by said one control shift element and/or a least one local control shift element in the vicinity of said one control shift element in the shift register in response to clocking of the shift register by the clock signal CK, and the shift register includes a chain of programmed shift elements having outputs which are set to define a control signal pattern on receipt of a reset signal, and each of the driver stages is locally controlled by at least one control signal generated by said one control shift element as a result of the control signal pattern appearing at the output of said one control shift element on clocking of the shift register by the clock signal.

5. An active matrix drive circuit according to claim 4, wherein the programmed shift elements comprise a number of control shift elements located in an end portion of the shift register, and the output of the last control shift element is connected to the input of the first control shift element of the shift register.

6. An active matrix drive circuit according to claim 4, wherein the programmed shift elements are additional to the control shift elements and are located in a portion of the shift register preceding the control shift elements so that the output of the last programmed shift element is connected to the input of the first control shift element.

7. An active matrix drive circuit according to claim 1, wherein each of the driver stages is locally controlled by at least one control signal generated by combinational or sequential local logic means associated with said one control shift element in response to input signals from said one control shift element and/or at least one local control shift element in the vicinity of said one control shift element in the shift register.

8. An active matrix drive circuit according to claim 7, wherein the outputs of said one control shift element and at least one local control shift element in the vicinity of said one control shift element are coupled to inputs of said local logic means associated with said one control shift element.

9. An active matrix drive circuit comprising:

a clock element arranged so as to generate a clock signal CK;

a shift register including a chain of control shift elements having respective outputs; and a series of driver stages coupled to said outputs and controllable by control signals for sampling an input signal and for supplying the sampled signals to a corresponding series of lines, wherein each of the driver stages is associated with a respective one of the control shift elements and is locally controlled by a plurality of different control signals derived from signals generated by said one control shift element and/or a least one local control shift element in the vicinity of said one control shift element in the shift register in response to clocking of the shift register by the clock signal CK, the shift register includes a chain of programmed shift elements having outputs which are set to define a control signal pattern on receipt of a reset signal, and local pattern detection means connected to the output of at least one control shift element is adapted to generate a control signal in response to detection of the control signal pattern when the control signal pattern appears at the output of said one control shift element as a result of clocking of the shift register by the clock signal.

10. An active matrix drive circuit according to claim 1, for an active matrix device, comprising an active matrix of control elements disposed at intersections of data lines and scan lines, wherein each of the driver stages is arranged to supply a data signal to a respective one of the data lines in a line period determined by a scan line driver.

11. An active matrix drive circuit according to claim 10, for a digital active matrix device, wherein each of the driver stages is arranged to sample a digital input signal and to store the sampled signal in a storage element, and digital-to-analogue conversion means is provided for converting the sampled signal to analogue format prior to supplying the signal to the corresponding data line in response to a control signal supplied by sample/shift means.

12. An active matrix drive circuit for an active matrix device having an active matrix of control elements disposed at intersections of data lines and scan lines, comprising:

a clock element arranged so as to generate a clock signal CK;

a shift register including a chain of control shift elements having respective outputs; and a series of driver stages coupled to said outputs and controllable by control signals for sampling an input signal and for supplying the sampled signals to a corresponding series of lines, wherein each of the driver stages is associated with a respective one of the control shift elements and is locally controlled by a plurality of different control signals derived from signals generated by said one control shift element and/or a least one local control shift element in the vicinity of said one control shift element in the shift register in response to clocking of the shift register by the clock signal CK, each of the driver stages is arranged to supply a data signal to a respective one of the data lines in a line period determined by a scan line driver, and for sequentially addressing rows of control elements in successive line periods, each of the driver stages comprises a first actuator arranged so as to sample and store the input signal to produce data signals for a first group of control elements along a row in a first subperiod of a corresponding line period, the first actuator being further arranged so as to supply said data signals to the first group of control elements in a second subperiod of said line period, and a second actuator arranged so as to sample and store the input signal to produce data signals for a second group of control elements along said row in a second subperiod and for supplying said data signals to the second group of control elements in a subsequent subperiod.

13. An active matrix drive circuit comprising:

a clock element arranged so as to generate a clock signal;

a shift register including a chain of control shift elements having respective outputs; and a series of driver stages coupled to said outputs and controllable by control signals for sampling an input signal and for supplying the sampled signals to a corresponding series of lines, wherein each of the driver stages is associated with a respective one of the control shift elements and is locally controlled by at least one control signal derived from said one control shift element, the shift register includes a chain of programmed shift elements having outputs to define a control signal pattern containing more than one occurrence of each logic state, and each of the driver stages is locally controlled by at least one control signal generated as a result of said control signal pattern appearing at the output of said one control shift element on clocking of the shift register by the clock signal.

14. An active matrix liquid crystal display incorporating an active matrix drive circuit according to claim 1.

* * * * *